US007014210B2

(12) United States Patent
Manninen et al.

(10) Patent No.: US 7,014,210 B2
(45) Date of Patent: Mar. 21, 2006

(54) HANDGRIP FOR A SKIING, WALKING OR SKATING POLE AND HANDSTRAP FASTENED TO THE SAME

(75) Inventors: Taisto Manninen, Maentyharju (FI); Jukka Juselius, Vantaa (FI)

(73) Assignee: Exel OYJ, Maentyharju (FI)

( * ) Notice: Subject to any disclaimer, the term of this patent is extended or adjusted under 35 U.S.C. 154(b) by 70 days.

(21) Appl. No.: 10/466,753

(22) PCT Filed: Jan. 18, 2002

(86) PCT No.: PCT/FI02/00038

§ 371 (c)(1),
(2), (4) Date: Nov. 12, 2003

(87) PCT Pub. No.: WO02/062434

PCT Pub. Date: Aug. 15, 2002

(65) Prior Publication Data

US 2004/0075268 A1 Apr. 22, 2004

(30) Foreign Application Priority Data

Jan. 22, 2001 (FI) ..... 20010126

(51) Int. Cl.
*A63C 11/00* (2006.01)

(52) U.S. Cl. ..... 280/821

(58) Field of Classification Search ..... 280/821–823, 280/819; 135/72

See application file for complete search history.

(56) References Cited

U.S. PATENT DOCUMENTS

| | | | | |
|---|---|---|---|---|
| 4,130,293 A | * | 12/1978 | Hinterreiter | 280/822 |
| 4,416,036 A | | 11/1983 | Aho | |
| 5,294,152 A | * | 3/1994 | Jacobs | 280/821 |
| 5,316,340 A | | 5/1994 | Maltsev | |

FOREIGN PATENT DOCUMENTS

| | | | |
|---|---|---|---|
| DE | 3512371 | * | 10/1986 |
| DE | 94 01 287 U1 | | 5/1994 |
| EP | 0 546 183 A1 | | 6/1993 |
| FR | 2594702 | * | 12/1987 |
| SE | 430 216 B | | 10/1983 |
| WO | WO 90/14136 | * | 11/1990 |
| WO | WO 92/13612 | * | 8/1992 |
| WO | WO 94/05384 | * | 3/1994 |

* cited by examiner

*Primary Examiner*—Bryan Fischmann
(74) *Attorney, Agent, or Firm*—Rothwell, Figg, Ernest & Manbeck, P.C.

(57) ABSTRACT

A handgrip for a skiing pole and a handstrap fastened to the same, the handstrap including an opisthenar-surrounding strap portion (3) which attaches to a handgrip (1) by way of transmission straps (4, 5) extending under the palm and thumb. The transmission straps (4, 5) are guided inside the handgrip through slots (6, 7) present on opposite lateral surfaces of the handgrip and inclined obliquely downward on the way towards the rear side of the handgrip. Above the slots (6, 7), the strap runs are secured between a wedge-shaped clamping element (8) and the internal walls of a cavity present within the top end of the handgrip.

10 Claims, 4 Drawing Sheets

HANDGRIP FOR A SKIING, WALKING OR SKATING POLE AND HANDSTRAP FASTENED TO THE SAME

BACKGROUND OF THE INVENTION

1. Field of the Invention

The invention relates to a handgrip for a skiing, walking or skating pole and a handstrap fastened to the same.

2. Description of the Related Art

This type of handgrip-handstrap assemblies have been manufactured and sold for several years by the Applicant, and by other manufacturers as well. One advantage is a convenient length adjustment for transmission straps, whereby the web between the thumb and the index finger is brought to the proximity of the fulcrum or turning point between the pole and the hand. Transmission of force occurs also in a manner preferably resembling traditional belt transmission, such that the force proceeds from the opisthenar side around the ball of the thumb and the underside of the palm to transmission straps present on the front side of the palm. A control strap between the back of the hand or opisthenar and the handgrip-provides a further improvement regarding a feel or response for the pole. This type of control strap is prior known e.g. from patents NO-160116 and SE-419168, which nevertheless do not disclose a length adjustment feature for transmission straps.

Patent publication EP-0357517 discloses an assembly of a handstrap and a glove, wherein the handstrap includes a wrist-enclosing cuff which is provided with a skirt extending below the side of the palm, which attaches by way of a palm-side transmission strap to a clamping element present within a space between the thumb and the index finger and whereby the assembly consisting of a handstrap and a glove can be disengaged from the handgrip, as desired. Between the clamping element and the wrist-enclosing cuff on the opisthenar side is a control strap, having a function of retaining the clamping element within the space between the thumb and the index finger even when a grip of the hand on the handgrip is totally released. Quick-release fastening requires a release action before the hand can be disengaged from the handgrip for other duties. The strap system provided with a control strap is difficult to dimension to a correct tightness for proper skiing. The clamping element present within a space between the thumb and the index finger impedes the use of a hand released from the handgrip for other duties. The clamping elements also hamper the length adjustment of a strap system to fit hands of various sizes. The wrist-enclosing cuff is located in a wrong position, on the wrong side of the wrist joint, with the result that there is no strap portion in the opisthenar area to take up a force occurring during a thrusting action.

In the above type of a handgrip-handstrap assembly, which has become known through use, the transmission straps are guided inside the top end of the handgrip through a single opening present on the rear side of the handgrip. Thus, the fulcrum of power transmission is set at a small distance from the center axis of a pole and the transmission straps apply stress on the web between the thumb and the index finger over a narrow zone.

This drawback appears also in the solution disclosed in patent EP-0357517. The latter involves a further drawback that the skier cannot freely choose his or her gloves according to the size of his/her hand and/or weather conditions but is compelled to wear the glove equipped with transmission straps and clamping elements. The range and availability of such gloves is of course less diversified and abundant than those of mere gloves.

Patent U.S. Pat. No. 4,775,168 discloses a handgrip-strap assembly, wherein the handstrap has its ends mounted with pivot axles on opposite sides of the handgrip. The handstrap has its length adjustment included in the strap section placed on the opisthenar side, which is a considerably more unreliable solution than a length adjustment implemented in connection with clamping elements and which additionally limits the possibilities of giving a handstrap an ergonomically flared design. In other respects as well, the handgrip design serves alpine skiing and is poorly suitable for cross-country skiing, e.g. for the reason that the mounting axle for handstrap ends is located too close to the top of the handgrip, the design of whose rear portion as a backward-extending dog is not fit for cross-country skiing as the pole swings to form a direct extension of the arm during a backswing action of the arm.

SUMMARY OF AN EMBODIMENT OF THE INVENTION

It is an object of the invention to further improve the above type of a handgrip-handstrap assembly in such a way that the transmission of force can be distributed along the sides of a handgrip in a per se known fashion as known from patent U.S. Pat. No. 4,775,168, yet without the above-cited drawbacks.

This object is achieved with the invention in that the force transmission strap portions are guided inside the handgrip through slots present on opposite lateral surfaces of the handgrip and inclined obliquely downward on the way towards the rear side of the handgrip. The dependent claims disclose preferred embodiments of the invention.

BRIEF DESCRIPTION OF THE SEVERAL VIEWS OF THE DRAWINGS

One exemplary embodiment of the invention will now be described in more detail with reference to the accompanying drawings, in which.

DETAILED DESCRIPTION OF AN EMBODIMENT OF THE INVENTION

Figure 1:
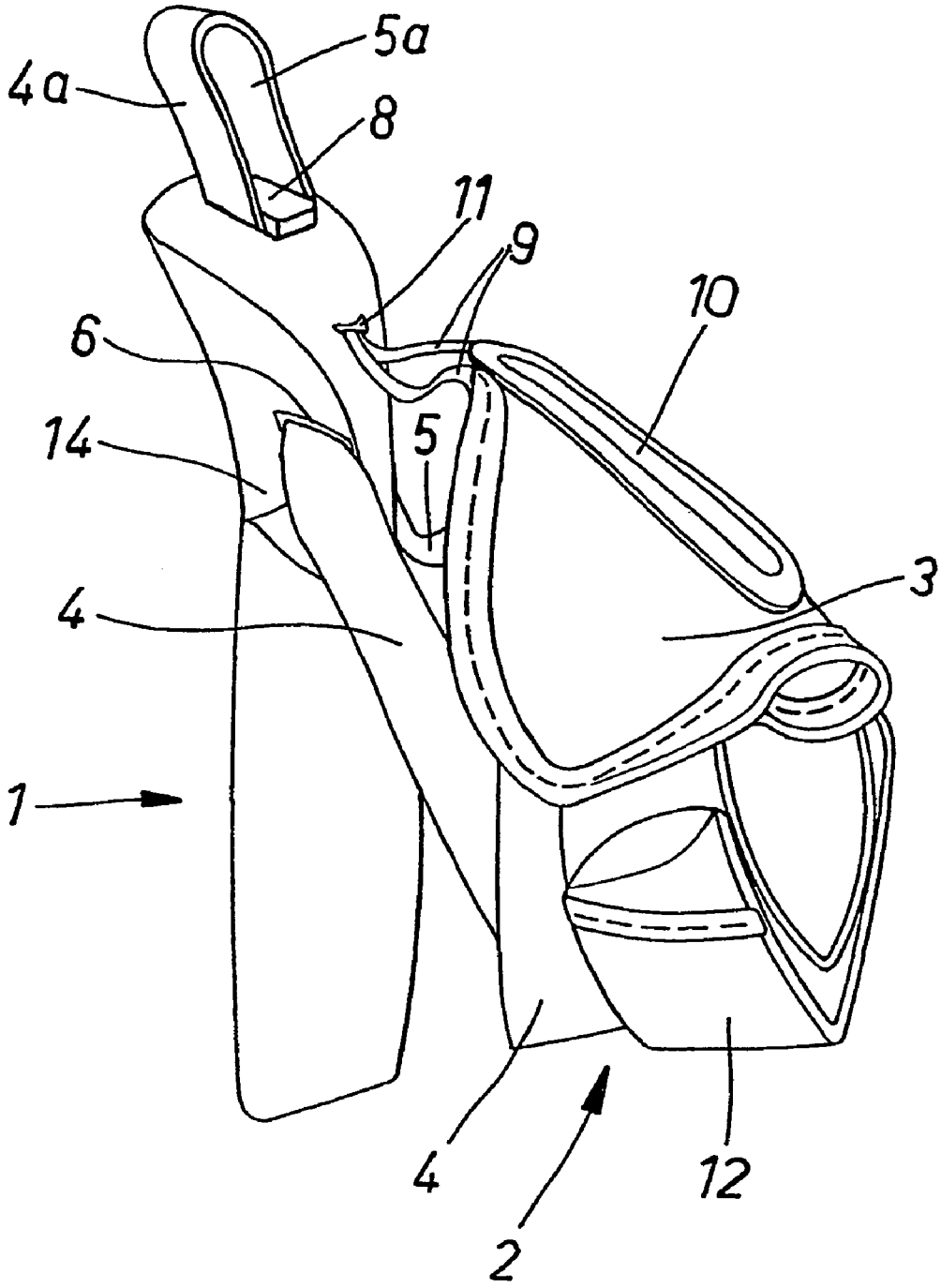
FIG. 1 shows a handgrip-handstrap assembly for the left hand in a view from the left-hand side.
Figure 2:
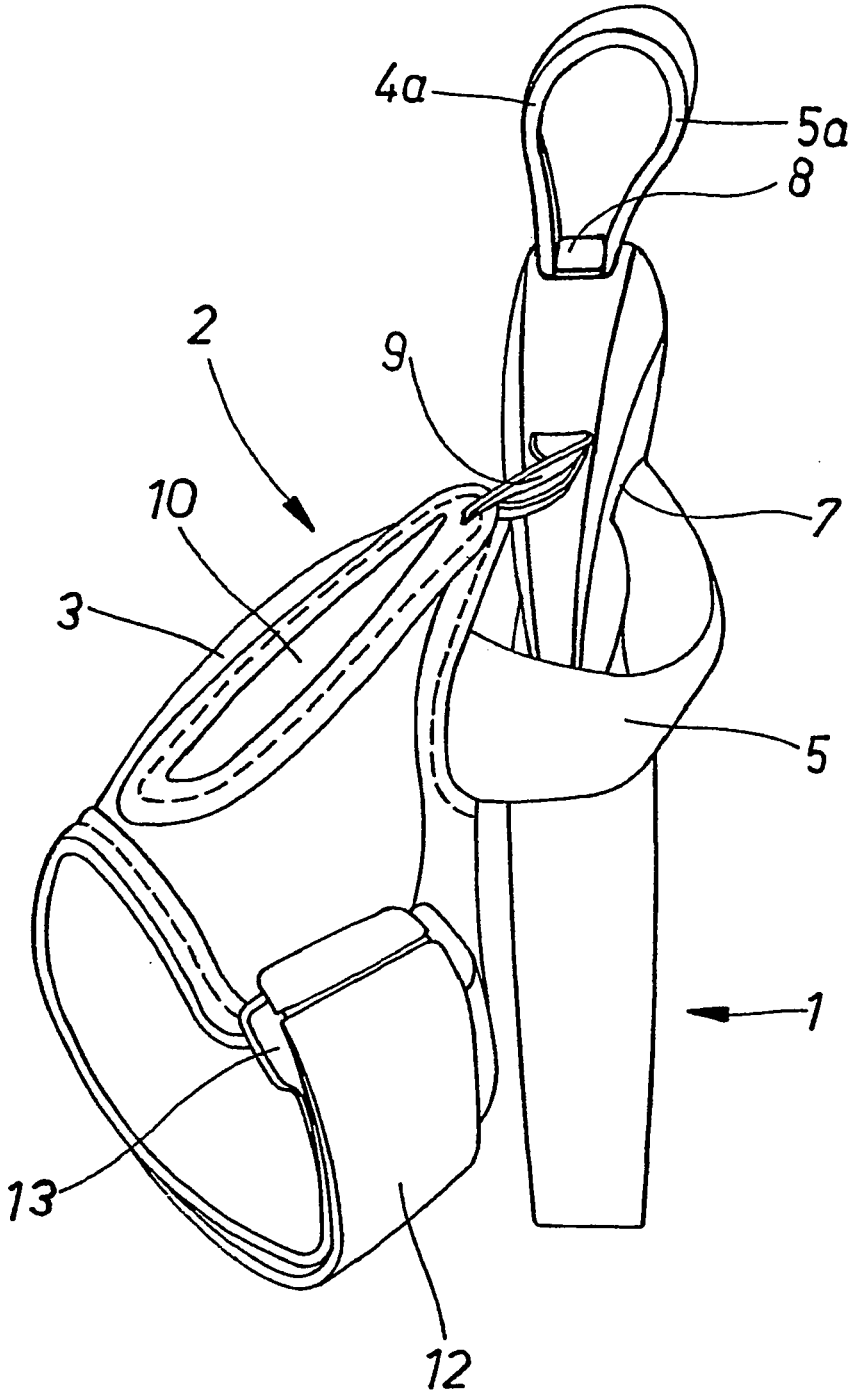
FIG. 2 shows the handgrip-handstrap assembly of FIG. 1 in a view from behind.
Figure 3:
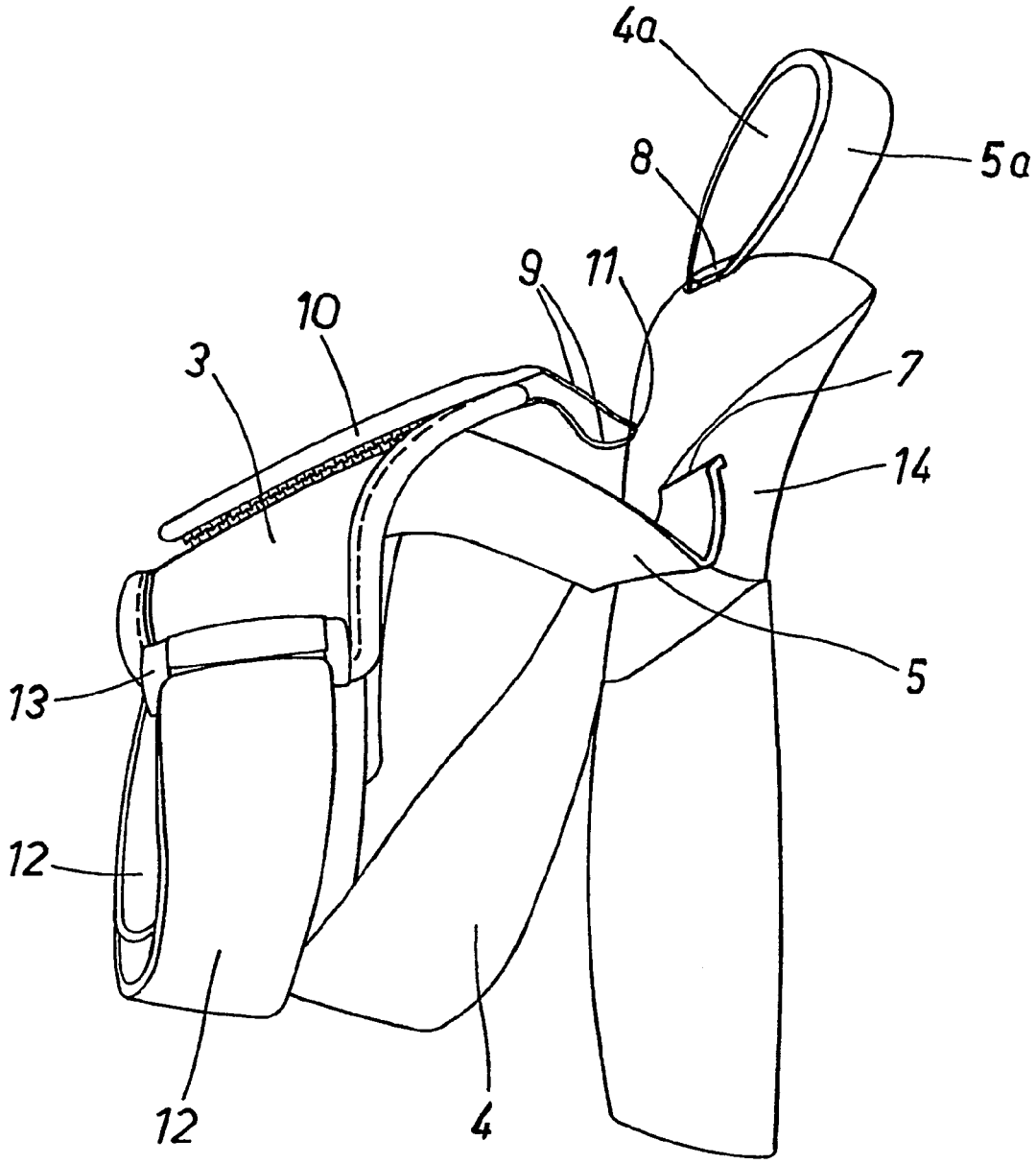
FIG. 3 shows the same handgrip-handstrap assembly for the left hand in a view from the thumb side.

A handgrip 1 is fitted with a handstrap 2, comprising a strap portion 3 extending around the back of the hand, which attaches to the handgrip 1 by way of force transmission strap portions 4, 5 extending under the palm and thumb. The handgrip 1 has its opposite lateral surfaces provided with slots 6, 7, which are inclined obliquely downward on the way towards the rear side of the handgrip. The transmission strap portions 4, 5 are guided inside the top end of the handgrip through the slots 6, 7.

Above the slots 6, 7 inside the handgrip top end is a wedge-shaped clamping element 8, whereby the runs of the transmission strap portions 4, 5 through the handgrip top end are securable between the clamping element 8 and the inner walls of a cavity present within the top end of the handgrip 1. The strap runs have ends 4*a*, 5*a* thereof protruding from the handgrip top end, and said ends are joined together for a closed loop which can be grabbed with a finger when it is desirable to pull the clamping wedge 8 up for a length adjustment of the transmission strap portions 4, 5. The length of each strap 4, 5 run or end 4*a*, 5*a* is independently adjustable, whereby the correct positioning for a handstrap both around the thumb and the palm is accurately adaptable to varying size hands, even to such an extent that the thickness variation of a skiing glove can be accounted for.

A control strap 9 connects the opisthenar-surrounding strap portion 3 to the rear side of a handgrip, which is provided e.g. with two slots, having therebetween a web 11 around which extends the control strap 9 as a lengthwise adjustable strap loop whose free end is provided with an adhesive tab 10. The adhesive tab 10 has on its bottom side a Velcro surface, which can be adhered to a responsive adhesive surface present on the top side of the opisthenar-surrounding strap portion 3 in an arbitrarily selected adjustment position. The control strap 9 has its attachment point of web 11 slightly higher up than either one of the slots 6, 7 or substantially level with the top end of the inclined slot 6, 7.

There may be a minor difference in vertical positions between the slots 6, 7, which is within the range of 3–20 mm. Such a difference in vertical positions can be used to look for optimal fulcrums between the top side of a palm and the bottom side of a thumb as the hand pivots away from the handgrip while the thrust still continues.

The handgrip 1 is provided with a reduction 14, the slots 6, 7 being located within its boundaries, preferably in its upper section, in such a manner that the handgrip has its thinnest part in the vicinity of the slots 6, 7 or slightly below the same. This design promotes both transmission of force and control of the pole in various actions. Above the slots 6, 7, the handgrip has a knob-shaped top end which rises to a considerable height and a rear side which is prominently inclined forward. The significance of this design has been described in more detail in the Applicants' patent U.S. Pat. No. 4,288,101. During a backswing action of the pole, as the hand releases its hold of the handgrip, the rear face of the handgrip located above the transmission strap portions presses against the side of the hand above the web or space between the index finger and the thumb. This provides an excellent guidance action or response of the pole and, thus, the force of a return action need not be transmitted by means of the control strap 9. However, the control strap 9 makes sure that, as a return motion of the pole continues, the handgrip is guided back to the hand even if the hand's squeezing action were delayed. The control strap 9 does not have a function of actual force or power transmission.

The opisthenar-surrounding strap portion 3 has its ends joined together by an elastic wrist strap 12 capable of retaining the transmission strap portions 4, 5 and the strap portion 3 permanently around the hand. The strap portion 3 is generally triangular in shape and the guide strap 9 is secured to the forward apex of the triangle. The transmission strap portion 4 coming around the bottom edge of the palm and the transmission strap portion 5 extending under the thumb constitute a traditional strap loop, the triangular strap portion being fastened to its opisthenar-side section.

The wrist strap 12 has a buckle which is fastened to the edge of the triangular strap portion 3. The wrist strap 12 is able to slide through a buckle 13 for adjusting the wrist strap regarding its length and tightness. The wrist strap 12 has its free end attachable with a VELCRO® hook and loop attachment to the outer surface of the wrist strap between the attachment end and the buckle 13.

The inclined slots 6, 7 have an angle relative to a horizontal plane within the range of 10°–40°, preferably within the range of 15°–30°. The handgrip extends at least 2.5 cm, preferably about 3 cm, above the slots 5, 6. This provides a space for a sufficiently long clamping wedge 8, the strap runs being located on either side thereof. The slots 6, 7 are located slightly closer to the rear side of the handgrip than the forward side thereof. However, the transmission of force from the straps to the handgrip occurs sufficiently close to the center axis of the pole, on either side thereof, in order to reduce a bending load applied to the pole.

Figure 4:
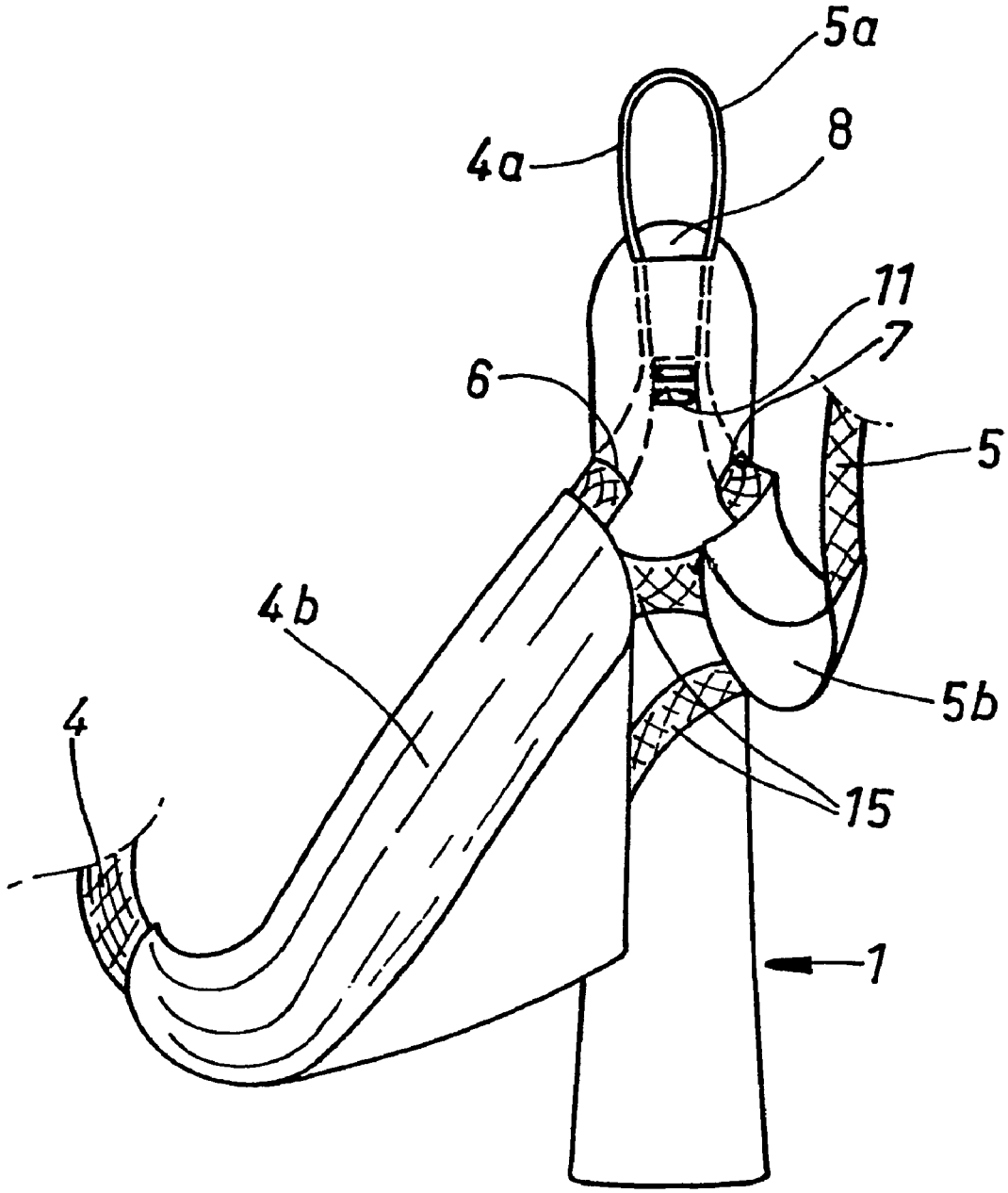
FIG. 4 shows an alternative embodiment of the invention, which differs from those of FIGS. 1–3 in that transmission strap portions 4 and 5 are supplemented with a palm backing 4*b* and a thumb support 4*a*.

The exemplary embodiment of FIG. 4 differs from what has been described above in that the transmission strap portion 4 is fitted with a shaped backing or support element 4*b* remaining under a palm grip, and the transmission strap portion is fitted with a support element 5*b* remaining under the thumb. The backing element 4*b* has a top surface which is concave and extends obliquely downward diverging from the handgrip 1. The support element 5*b* has a top surface which is gently gutter-shaped for accommodating the thumb. Short strap sections present between the support elements 4*b*, 5*b* and the slots 6, 7 define a pivot axis and at the same time enable a length adjustment for the transmission strap portions 4, 5. In the illustrated case, the support elements 4*b*, 5*b* are secured to each other by means of intermediate straps 15. The intermediate straps 15 can be replaced also with a rigid connecting web for linking the support elements 4*b*, 5*b* for a single element. In any case, a multitude of variations can be applied in designing the support elements 4*b*, 5*b* and a support element for the thumb or the palm can be used also by itself without the other support element. For example, the palm backing or support can be limited to only cover the bottom edge of the palm, whereby it has a function of neutralizing the squeezing applied by a strap extending around the bottom edge of the palm. Alternatively, a thumb and/or palm support can be positioned and fastened separately to a skiing glove. Both thumb and palm side support or backing elements are prior known as integral parts of a handgrip. The difference between such prior art and the invention is that the support elements 4*b*, 5*b* are able to pivot along with the hand with respect to the handgrip 1.

The invention claimed is:

1. A handgrip for a skiing, walking or skating pole and a handstrap (2) fastened to the same, comprising an opisthenar-surrounding strap portion (3) which attaches by way of force transmission strap portions (4, 5) for extending under a palm and thumb to a handgrip (1) provided with an opening for a lead-through of the force transmission strap portions (4, 5) and with a clamping element (8) above the opening inside a top end of the handgrip, by which runs of the force transmission strap portions (4, 5) can be secured between the clamping element (8) and internal walls of a cavity present within the top end of the handgrip (1) in such a way that each force transmission strap portion (4, 5) has its length independently adjustable with ends (4*a*, 5*a*) of the runs of the force transmission strap portions (4, 5) protruding out of the top end of the handgrip, the handgrip having a rear side which is opposite to an advancing direction of a user holding the handgrip during skiing, walking, or skating, characterized in that the force transmission strap portions (4, 5) are guided inside the handgrip through slots (6, 7) present on opposite lateral surfaces of the handgrip and inclined obliquely downward on the way towards the rear side of the handgrip.

2. A handgrip as set forth in claim 1 and a handstrap secured thereto, characterized in that the handstrap includes a control strap (9) which connects the opisthenar-surrounding strap portion (3) to the handgrip (1), a length of said control strap (9) being adjustable, the control strap (9) comprising an adjustment loop around an attachment web (11) present in the handgrip, the adjustment loop having a free end connected with an adhesive tab (10) provided with a VELCRO® surface which is attachable to a responsive adhesive surface of the opisthenar-surrounding strap portion (3).

3. A handgrip as set forth in claim 1 and a handstrap secured thereto, characterized in that between inclined slots (6, 7) is a difference in height within the range of 3–20 mm.

4. A handgrip as set forth in claim 1 and a handstrap secured thereto, characterized in that the handgrip (1) is provided with a reduction (14), the inclined slots (6, 7) being located in the vicinity thereof, the handgrip (1) having a thinnest part in the immediate vicinity of or slightly below the slots (6, 7).

5. A handgrip as set forth in claim 1 and a handstrap secured thereto, characterized in that the opisthenar-surrounding strap portion (3) has ends joined together by an elastic wrist strap (12) capable of retaining the transmission strap portions (4, 5) and the opisthenar-surrounding strap portion (3) permanently around a hand.

6. A handgrip as set forth in claim 5 and a handstrap secured thereto, characterized in that the opisthenar-surrounding strap portion (3) is generally triangular in shape, and that the transmission strap portion (4) and the transmission strap portion (5) comprise a strap loop, the opisthenar-surrounding strap portion (3) being attached to an opisthenar-side part of said loop.

7. A handgrip as set forth in claim 6 and a handstrap secured thereto, characterized in that the wrist strap (12) has a buckle (13), through which the wrist strap is able to slide for adjusting its length and tightness, said buckle being secured to the edge of the triangular strap portion (3), the wrist strap (12) having a free end attachable with a VELCRO® attachment to an outer surface of the wrist strap between the attachment end and the buckle (13) of the wrist strap.

8. A handgrip as set forth in claim 1 and a handstrap secured thereto, characterized in that the inclined slots are at an angle relative to a horizontal plane within a range selected from the group consisting of 10°–40°, and 15°–30°.

9. A handgrip as set forth in claim 1 and a handstrap secured thereto, characterized in that ends of the runs of the force transmission strap portions (4, 5) protrude from the top end of the handgrip and are fastened together to form a strap loop.

10. A handgrip as set forth in claim 1 and a handstrap secured thereto, characterized in that the transmission strap portions (4, 5) are fitted with a shaped support element.

* * * * *